United States Patent [19]

Olivier

[11] 4,427,059

[45] Jan. 24, 1984

[54] WIRE LINE CUTTER APPARATUS

[76] Inventor: Eric J. Olivier, Rte. 2, Box 673, Schriever, La. 70395

[21] Appl. No.: 335,832

[22] Filed: Dec. 30, 1981

[51] Int. Cl.[3] ..... E21B 29/04

[52] U.S. Cl. ..... 166/54.6

[58] Field of Search ..... 166/54.5, 54.6; 83/580, 83/610, 611, 612; 114/221 A; 102/415; 89/173; 173/93

[56] References Cited

U.S. PATENT DOCUMENTS

| | | | |
|---|---|---|---|
| 756,760 | 4/1904 | Wolf | 166/54.6 |
| 969,571 | 9/1910 | Spang | 166/54.6 |
| 969,755 | 9/1910 | Spang | 166/54.6 |
| 1,325,901 | 12/1919 | Nichols | 166/54.6 |
| 1,610,699 | 12/1926 | Montgomery | 166/54.6 |
| 1,867,033 | 7/1932 | Spang | 166/54.6 |
| 3,073,388 | 1/1963 | Chenault | 166/54.5 |

*Primary Examiner*—Stephen J. Novosad
*Assistant Examiner*—Joseph Falk
*Attorney, Agent, or Firm*—Bode & Smith

[57] ABSTRACT

A wire line cutter that is slidably engaged upon a wire line tool. The apparatus includes a blade that will, upon impact with the wire line tool, slide from a generally vertical orientation to a generally horizontal orientation.

5 Claims, 13 Drawing Figures

WIRE LINE CUTTER APPARATUS

BACKGROUND OF THE INVENTION

1. Field of the Invention

The present invention relates to wire line cutting apparatuses, and more particularly the present invention relates to a wire line cutter apparatus for severing a wire line in the event a down hole tool has been jammed within the bore hole.

2. General Background

In the operation of gas/oil wells, the use of a flexible wire line to lower various types of down hole tools into the well bore is very common. As an example, during the drilling and during the completion of an oil well, production logging apparatuses are run down into the well bore, via the use of a wire line, and having an electrical cable also for enabling the apparatus to achieve readouts while in the well bore, including such things as temperature and pressure surveys, and the placement and removal of production and controlled gas lift valves, etc. All of these apparatuses are lowered down into the bore with the use of a wire line, which is a flexible steel cable or the like, so that once the services or readouts are complete, under normal circumstances, the instrumentality is retrieved out of the bore hole. However, as often is the case, these instrumentalities become locked due to debris down the hole, or improper alignment of the bore. What is required at that point is a "fishing" tool which has to be lowered down into the hole to retrieve the readout apparatus.

In most cases, the down hole tool which is lowered at the end of the wire line, is adapted with some sort of retrieval means so that the "fishing" tool may grasp onto the upper end of the apparatus, and retrieve it up out of the bore hole. This is usually the case when the tool is stuck rather firmly into the hole. It would be unwise to try to exert undo pressure on the apparatus by pulling on the wire line from the rig floor, due to the fact that the wire line may snap at any point at sometimes 10 to 30,000 foot hole, and therefore result in thousands of feet of wire line being or dropping down into the bore hole and causing an even more severe problem. Therefore, in order to combat this eventuality, it is often times wise to sever the wire line at a point very close to the top portion of the down hole tool, and retrieve the wire line prior to retrieving the down tool with a "fishing" tool.

In the present state of the art, what is normally achieved is some sort of a cutter or the like would be slidably engaged to the wire line at the top of the bore hole, while the wire line is rather taut, and it would be allowed to slide down the cable with the use of gravity or the like. Several patents do teach the use of types of cutters and they are are follows:

U.S. Pat. No. 3,926,252 teaches the use of a cutting device for flexible line having a tubular body, a fixed blade member and a rotating blade member. The members are engagable into one another, and would be activated upon the striking of the tool by a separate "go devil" drop down the hole after the cutting portion has been placed in position.

U.S. Pat. No. 745,526 would teach the use of an apparatus for cutting rope, the apparatus being adopted for dropping into a hole or otherwise for severing the rope when it comes into contact with a stationary object.

U.S. Pat. No. 1,610,699 would teach the use of an apparatus for dropping into a hole or the like for severing a rope with movable blades when the apparatus strikes a stationary object.

U.S. Pat. No. 756,730 would teach the use of an apparatus also for dropping into the hole or the like for severing a wire line.

U.S. Pat. No. 692,816 would teach the use of an apparatus also for dropping down a bore or the like for severing a rope or cable when the apparatus strikes an object.

U.S. Pat. No. 969,571 would teach the use of a rotatable blade for severing a line as the apparatus is dropped in a hole and strikes a stationary object.

U.S. Pat. No. 978,577 would also teach the use of an apparatus for dropping down the hole, so that when the apparatus strikes an object, a pair of blades, which are mounted on a rotatable shaft, move into the line and sever it.

U.S. Pat. No. 3,073,388, which would comprise a body slidably inserted over the cable and a pivotally mounted blade which cooperates with the cutting head of the body to cut the cable on the top of the well tool. In this patent, the blade is actuated by an explosive charge fired by a timing mechanism.

None of the above patents as listed, would achieve the ends which are achievable with the present invention. Particularly in U.S. Pat. Nos. 3,073,388 and 3,926,252, the disadvantages are that the cutting portion of the apparatus is struck with considerable force, either by the explosive charge in the '388 patent or in the force of the "go devil" as it has travelled down the well hole in the 252 patent. In both of those cases, the energy imparted on the blade member would cause a great crushing of the cable prior to the completion of the cut.

GENERAL BACKGROUND OF THE PRESENT INVENTION

The preferred embodiment of the present would solve the problems found in the present state of the art in a simple and inexpensive manner. What is provided is a wire line cutter apparatus which would be slidably engaged upon a wire line extending down a bore hole. The apparatus would have a cutter portion which would include a blade member slidably mounted on a surface within the cutter portion, so that upon impact, the blade member would slide from a generally vertical to a generally horizontal position, moving from a position to one side of the channel to the opposite side of the channel intersecting the channel through which the wire line is aligned, and thus severing the wire line through the movement of the blade member against the wall of the channel. The activation of the blade from the vertical to the horizontal is caused by an elongated housing positioned around the cutter portion to make contact with the blade for rotation thereof. In the preferred embodiment, the cutter apparatus would be dropped down the well bore, and upon striking the down hole tool, the force of the housing would cause impact upon the blade for severing the wire line.

Therefore, it is a primary object of the present invention to provide a wire line cutter apparatus adapted for cutting wire line which is suspending a well tool, at a location proximate the upper portion of the well tool in the bore hole.

It is a further object of the present invention to provide a wire line cutting apparatus having a blade member which is activated upon the wire line apparatus striking the down hole tool.

It is a further object of the present invention to provide a wire line cutter apparatus which eliminates the possibility of having excessive wire down the hole should the wire be severed at an inexact point.

It is still a further object of the present invention to provide a wire line cutter apparatus whose cutting force depends upon gravity and not an external force or charge.

In order to achieve the above objects of the present invention, it is a feature of the wire line cutter apparatus to provide a first cutter portion housing a rotatably mounted blade.

It is still a second feature of the present apparatus to provide an external housing of the cutter portion for serving as an anvil or impact force upon the cutter portion of the apparatus.

It is still a further feature of the apparatus to provide the cutting edge blade directed upward in the nonoperative position, so that the blade does not become hung up while the tool is being slid down the wire line.

It is yet a further feature of the apparatus to provide a sheer pin means for preventing the premature severing of the wire line, should the tool engage an object down the bore hole which is not the object of the severing.

FIGS. *2a* through *2c* illustrate various views of the wire line apparatus travelling down the bore hole and retrieval thereof.

FIGS. *3a* through *3c* illustrate various views of the cutting blade of the apparatus of the present invention.

FIGS. *4a* and *4b* illustrate a side and top view respectively of the upper portion of the cutter portion of the apparatus.

FIGS. *5a* through *5c* illustrate various views of the blade housing portion of the apparatus of the present invention.

DETAILED DESCRIPTION OF THE PREFERRED EMBODIMENT

Figure 1A:
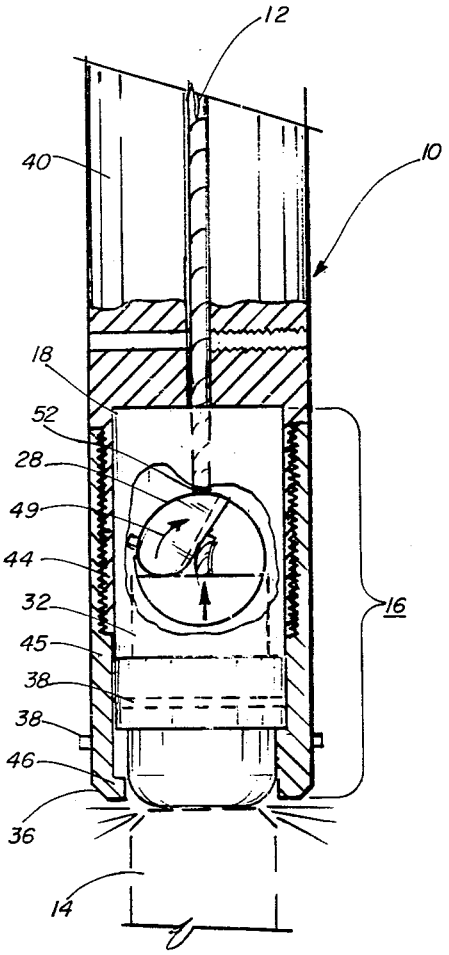
FIGS. 1A and 1B illustrate in partial cut-away view the wire line cutter apparatus as it is travelling down the bore hole and striking the down hole tool for severing of the wire line.
Figure 1B:
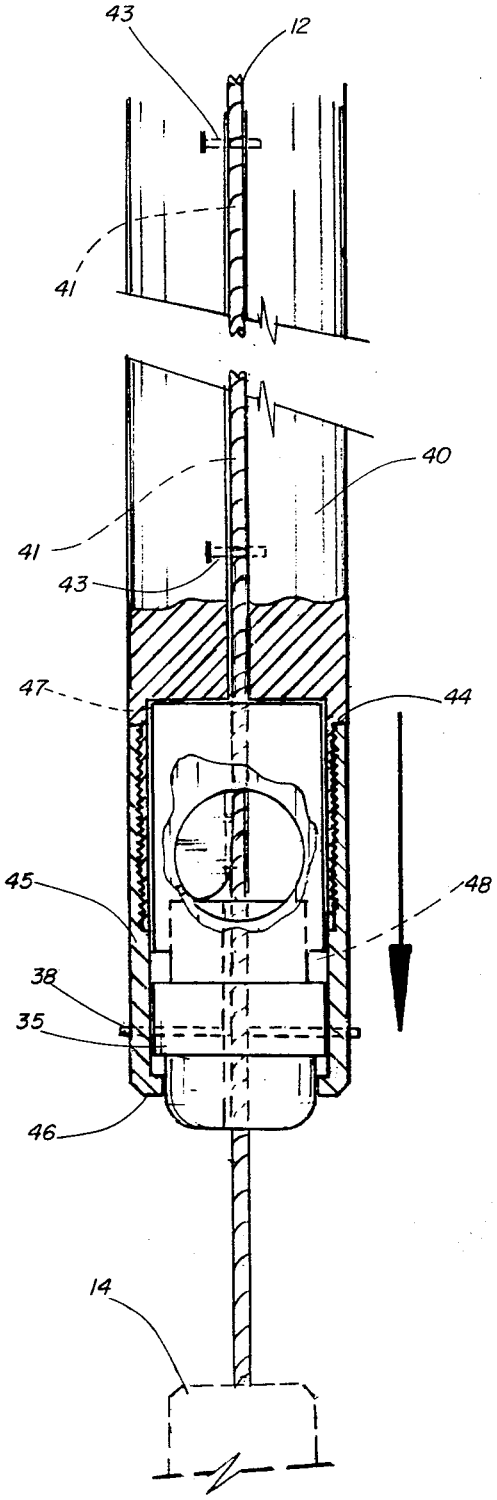

Reference is made to FIGS. *1a* and *1b*, wherein the preferred embodiment of wire line cutter apparatus 10 is illustrated. Wire line apparatus 10 is principally adapted for use in cutting a flexible wire line 12, such as is illustrated in FIGS. 1A and 1B. Wire line 12 would, in the course of its functioning, suspend a down hole tool 14 or the like in a bore hole so that the tool can be utilized in measuring certain features of the strata in the bore. Apparatus 10 would come into use in the occasion when the down hole tool 14 would become obstructed or jammed within the bore hole, and could not be retrieved unless the wire line were to be cut so that a fishing tool could be lowered to retrieve the down hole tool 14. Apparatus 10 is such a cutting device, which is designed to be lowered through gravity down the wire line and upon coming into contact with the upper end of the down hole tool 14, the wire line would be severed at a point adjacent the origin of the wire line from the down hole tool 14.

Figure 5A:
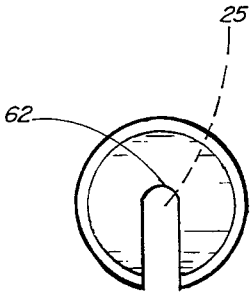

Wire line cutter apparatus 10 comprising a lower cutter portion 16, as illustrated in FIG. 1A, which further comprises an upper housing portion 18 which is essentially a cylindrical hollow body, having a slot 25 as is illustrated in top view in FIG. 5A. Slot 25 would run the entire length of upper housing portion 18, and would enable the wire line 12 to be placed into the upper housing portion 18 during the positioning of the wire line into the apparatus 10. Upper housing portion 18 is further provided with a bore 21, which is of a circumference substantially equal to the circumference of upper body portion 18, and, as is illustrated in FIG. 5B, forms concave areas 22 and 23 on either end of bore 21. In the preferred embodiment, bore 21 functions as the housing area for rotatable blade 24 which will be discussed further, as is illustrated in FIGS. 1A and 1-B. As will be discussed further in the functioning of the apparatus, surface 28 of blade 24 is at a curvature which coincides with the curvature of the inner surface 26 of bore 21 during the rotation of blade 24 while the apparatus 10 is functioning.

Figure 5C:
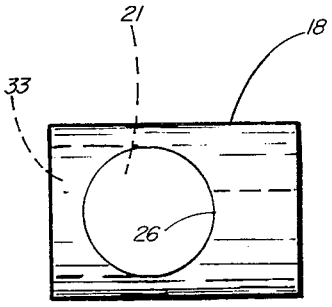
Figure 5B:
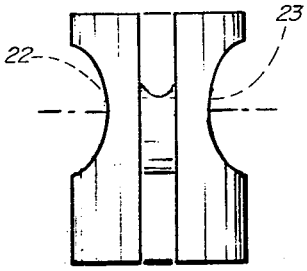
Figure 3B:
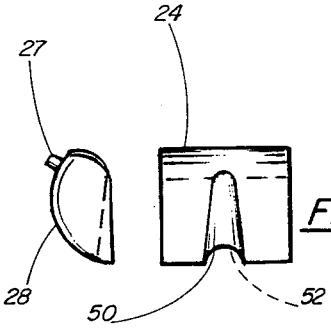
Figure 3C:
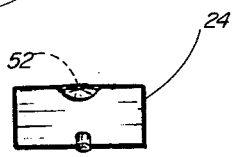

As is further illustrated in FIGS. 5A through 5C, slot 25 also serves as a track for peg 31, hammer portion 30, as blade 24 rotates in the functioning of the apparatus. Peg 31 running in track or slot 25 eliminates the possibility of misalignment of hammer portion 30 within housing 18 during the functioning of the apparatus.

Figure 2A:
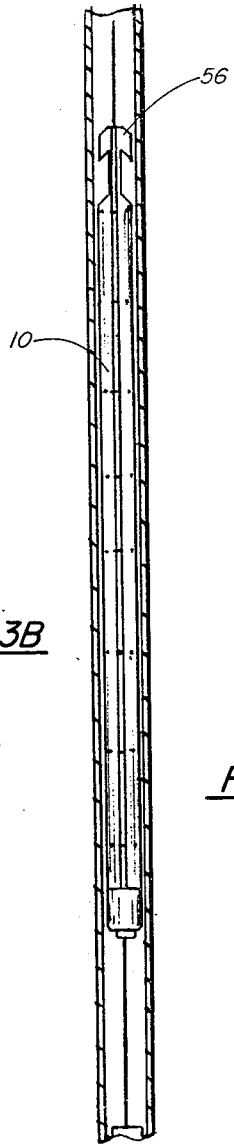
Figure 2B:
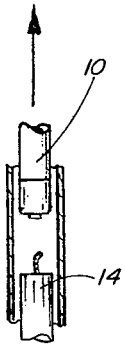
Figure 2C:
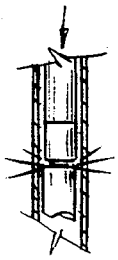

Cutter portion 16 further comprises lower hammer portion 30 as illustrated in FIG. 4A. Hammer portion 30 is essentially a solid core substantially elongated portion having a neck portion 32 which slidably engages into the lower collar housing section 33 of upper blade housing 18. As seen in FIGS. 1 and 2, the upper surface 34 of neck portion 32 serves as a resting point for blade 24 and makes contact with the blade 24 while in the inoperative position. As seen in FIG. 1, the neck portion 32 of hammer portion 30 has been inserted into collar portion 33 of upper portion 18, and the cutting edge 50 of blade 24 is substantially in the vertical position in the nonoperative use, with wire line 12 running therethrough, adjacent to blade 24.

Figure 4B:
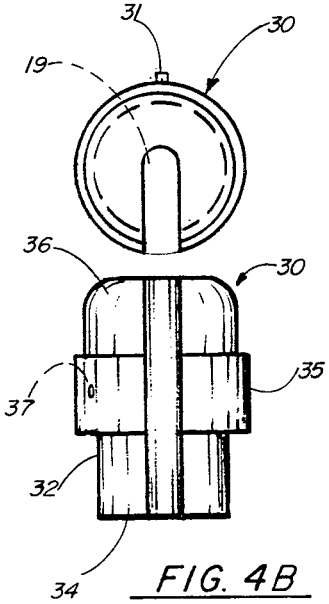

As further illustrated in FIG. 4B, hammer portion 30 further provides for an expanded collar portion 35 integrally mated with neck portion 32 on the lower end, and with impact portion 36 on its lower end. As is illustrated in FIGS. 4A and 4B, expanded collar portion 35 is provided with bore 37 therethrough, with bore 37 housing, during the "cocked" position, as seen in FIG. 2, a sheer pin 38, the function of which will be explained further.

In the preferred embodiment, as is illustrated in FIGS. 1A and 1B, lower cutter portion 16, during its use, would be inserted into the lower most end of carrier apparatus 40 which is essentially an elongated housing, substantially the somewhat wider width than lower cutter portion 16 due to the fact that housing 40 must house cutter portion 16 as is illustrated in FIGS. 1 and 2. Housing 40 would be substantially 4 to 6 feet in length, and contain groove 41 along its entire length for insertion of wire line 12, so that housing 40 may be placed correctly on wire line 12, for properly slidably engaging. In order to assure that housing 40 is maintained along its entire length along wire line 12, there is provided, as is seen in FIG. 1B, a plurality of screws or the like 43 which are placed at equal distances along its length, and serve to serve as stops for maintaining the wire line within the slot 41 of carrier apparatus 40.

As is illustrated in FIG. 1B, carrier 40 also provides for a lower end portion 44, which is rotatably and threadably engaged to the lower end 45 of carrier portion 40, with lower end portion 44 having inner directed lip portion 46, the function of which is to maintain lower cutter portion 16 in position as is illustrated in FIGS. 1A and 1B by engaging collar portion 35, upon placing cutter portion 16 into carrier 40. In assembling apparatus 10, lower portion 45 would be threadably disengaged from carrier portion 40, lower cutter portion 16 would be slidably fitted into the opening 47 in carrier portion 40, and lower portion 45 would be threadably re-engaged with carrier 40, with inner directed lip portion 46 serving to maintain lower portion 16 in position, with collar portion 35 disabling the lower portion 16 from sliding out of carrier portion 40.

During assembly, lower portion 16, would be placed onto wire line 12 by sliding wire line 12 into slot 19 of lower hammer portion. Likewise, housing 30 would also be slidably engaged onto wire line 12 via slot 25, with the upper neck portion 32 being fitted into the hollow portion 33, and blade 24 being positioned in the vertical position as seen in FIG. 1B, within blade housing 18. With the cutter unit 16 in position on wire line 12, elongated carrier housing 40 would then be positioned onto wire line 12, through slot 41, and screws 43 being placed along its length in order to maintain it on wire line 12. Assembled cutter portion 16 would then be slidably fitted into bore area 47 of carrier 40, and lid portion 45 would be threadably engaged to carrier 40, and maintain cutter portion 16 on carrier 40.

As is illustrated in FIG. 1-B, sheer pin 38 would then be slidably attached between the walls of end portion 45 through bore 37 of hammer portion 30, so that lower hammer portion 30 is in the cocked position, as is illustrated in FIG. 1B producing a gap 48 between the upper housing 1B and the hammer portion 30. Also illustrated in FIG. 1B, blade 24 in the cocked position, with the cutting edge 50 being substantially in the vertical position while the apparatus is in the inoperative use. Once the apparatus has been assembled as is illustrated in FIG. 1B, the apparatus is simply dropped down the bore hole along wire line 12, and it speeds down the hole gaining momentum as it is gravity pulled down towards the tool 14.

FIG. 1A illustrates the apparatus 10 impacting tool 14 down the bore hole. Upon impact of impact portion 36 against tool 14, hammer portion 30 would move upward through gap 48, simultaneously sheering the sheer pin 38 and causing rotation of the blade member. Upper neck portion 32 would impact blade 24 and cause blade 24 to rotate in the direction as arrow 49 illustrates in FIG. 1A, with the cutting edge 50 of blade 24 severing wire line 12 at point 52, thus accomplishing its task. Upon the severing of wire line 12, a "retriever tool" would then be lowered into bore hole, and would engage the fish end 56 of carrier portion 40, and retrieve the carrier portion 40 with lower cutter portion 16 and, thus wire line 12 could be pulled out of the hole and subsequent to the retrieval of apparatus 10, a fishing tool could be lowered to retrieve down hole tool 14.

Certain features of the apparatus should be discussed, as is illustrated in the FIGS. It should be noted that when the upper blade housing 18 of cutter portion 16 is slidably engaged with lower hammer portion 30, the slot 25 in housing 18 and the slot 19 in hammer portion 30, must be directed in opposite directions so that wire line 12 does not have the opportunity to slide out of slot 25 during use. To assure that such will take place, lower hammer portion 30 is provided with peg 31, which is located on the upper neck portion 32 of hammer 30, and peg 31 must engage into slot 25 of upper portion 16 in order for hammer portion 30 to properly slidably engage upper portion 16.

A second feature of the apparatus is that blade 24, in order to effectively operate, as illustrated in FIG. 2, must be directed upward, with the cutting edge 50 being in the top portion of the apparatus and rotating along the upper surface of housing 18 during the cutting operation. The positioning of blade 24 in the upward direction, rather than the lower direction, is essential, in that this prevents the chance of the cutting edge 50 of blade 24 prematurely engaging wire line 12 while apparatus 12 is being gravity fed down the bore hole, and thus prematurely severing the line. With the cutting edge being on the upper point, there is no possibility at all that blade 24 would engage wire line 12, and thus cause the severing to occur prior to the predetermined point upon striking down hole tool 14.

It should be further illustrated that the blade 24 has a notched area 52 wherein the cutting edge 50 is provided. This is so, so that prior to the incident that the wire line is cut, notch 52 allows the wire line to be "crushed", so that the wire line is not jaggedly severed and thus producing jagged ends. This crushing in the instant prior to severing the line itself, produces a cleaner cut, and this is effectuated by notch portion 52 serving to squeeze wire line 12 between cutting edge 50 and edge 62 of the upper portion of housing 18.

The placement of sheer pin 38 through the walls of lower portion 44 of carrier apparatus 40 and through the collar portion 35 of hammer 30, would serve as a deterrant against the apparatus prematurely severing the wire line, should apparatus 10, while it is being gravity fed down into bore hole, strike fluid or the like in the bore hole which would cause some impact upon hammer 30, but would not cause the necessary impact to properly sever sheer pin 38 and thus put the apparatus in the operative position. Therefore, sheer pin 38 serves as a control item of the apparatus which assures that the apparatus will not "go off" until such time that the apparatus does in fact strike a solid object, such as the down hole tool.

Since certain changes or modifications may be made in the disclosed embodiment without departing from the scope of the inventive concepts disclosed herein, it is the aim of the appended claims to cover all such changes and modifications falling within the true spirit and scope of the present invention.

What is claimed as invention is:

1. A wire line cutter apparatus, comprising:

a. an elongated member having a longitudinally extending channel for placement of the wire line to be cut;

b. cutter means, comprising;

i. an upper housing portion;

ii. a notched blade member rotatably mounted to allow substantial rotation of said blade member in said upper housing portion which moves substantially from a vertical inoperative position to a horizontal operative position;

iii. a cutting edge on said notched blade member that faces substantially upwards when said blade member is in said vertical inoperative position;

iv. a lower actuating member slidably engaged with said upper housing portion to cause rotation of said blade member upon contact of said actuating member with a down hole tool;

c. means for receiving said cutter means in the lower end of said elongated member;

d. a stationery edge formed by said longitudinal channel in said lower cutter means and positioned in opposition to movement of said blade member so that rotation of said blade member from the vertical to the horizontal along a path intersecting said channel through which said wire line is set, intersects said channel and wire line and crushes and severs said wire line between said cutting edge of said blade member and said stationery edge; and e. a sheer pin engageable with said lower actuating member and said means for receiving said cutter means so that premature rotation of said blade member to said operative position by said lower actuating member is prevented.

2. The apparatus in claim 1, further comprising, retrieval means at the upper end of said elongated member for retrieving said cutter apparatus after severing said wire line.

3. A wire line cutter apparatus for cutting a wire line while in a bore hole, which comprises;

a. lower cutter means, comprising:

i. a longitudinally extending channel adapted to slidably receive said wire line to be cut;

ii. a substantially horizontal bore therethrough defining a travelling surface;

iii. a notched cutter blade rotatably mounted to allow substantial rotation of said blade on said travelling surface of said cutter portion, said cutter blade positioned in a substantially vertical inoperative position and rotating in a clockwise manner to a substantially horizontal operative position;

iv. a cutting edge on said notched cutter blade that faces substantially upwards when said blade is in said vertical inoperative position;

v. a lower hammer portion slidably engaged within said lower cutter portion at said lower inoperative position and an upper operative position so that when in the operative position it causes rotation of the cutter blade;

b. an elongated member, comprising:

i. a longitudinally extending channel to house said wire line to be cut;

ii. means for maintaining said wire line to be cut within said channel;

iii. a lower housing portion for housing said cutter means, and;

iv. means for maintaining said cutter means within said lower housing portion;

c. a stationery edge formed by said longitudinal channel in said lower cutter means positioned opposite said blade member cutting edge so that when said blade member rotates along the path intersecting said channel through which said wire line is set said blade member intersects said channel and wire line and crushes and severs said wire line between said cutting edge of said blade member and said stationery edge;

d. retrieval means at the upper end of said elongated member for retrieving said apparatus after severing said wire line;

e. a shear pin, engageable through coinciding bores in said lower hammer portion and said lower housing portion, to maintain said lower hammer portion in said lower inoperative position until said lower hammer portion strikes a down hole tool.

4. The apparatus in claim 3, wherein said means for maintaining said wire line to be cut within said channel comprises a plurality of screws and oppositely aligned slots.

5. The apparatus in claim 3, wherein said means for maintaining said cutter means within said lower housing portion comprises a lower end portion threadably engaged to the lower end of said elongated member.

* * * * *